United States Patent [19]

Stewart

[11] Patent Number: 5,024,005

[45] Date of Patent: Jun. 18, 1991

[54] DEWATERING MEANS

[75] Inventor: Peter J. Stewart, Maddington, Australia

[73] Assignee: Seaford Nominees Pty Ltd., Australia

[21] Appl. No.: 440,225

[22] Filed: Nov. 22, 1989

[30] Foreign Application Priority Data

Nov. 23, 1988 [AU] Australia ..... PJ1603

[51] Int. Cl.[5] ..... F26B 9/00

[52] U.S. Cl. ..... 34/164; 34/57 A; 110/245

[58] Field of Search ..... 34/164, 57 A; 110/245

[56] References Cited

U.S. PATENT DOCUMENTS

| | | | |
|---|---|---|---|
| 3,089,688 | 5/1963 | Ostberg | 34/164 |
| 3,703,861 | 11/1972 | Slack et al. | 34/164 |
| 3,704,525 | 12/1972 | Devel | 34/164 |
| 4,305,210 | 12/1981 | Christensen et al. | 34/164 |
| 4,654,004 | 3/1987 | Miyoshi et al. | 34/164 |

*Primary Examiner*—Henry C. Yuen

*Attorney, Agent, or Firm*—Handal & Morofsky

[57] ABSTRACT

A dewatering apparatus having a delivery zone and a drying zone separated by a weir is disclosed. The delivery zone is provided with a porous floor plus an associated drain and the drying zone has a vibrating porous surface above an associated plenum chamber. The plenum chamber is connected to a source of a hot gaseous fluid.

8 Claims, 2 Drawing Sheets

DEWATERING MEANS

This invention relates to a dewatering means for dewatering pulp.

Throughout specification the term pulp shall be taken to include pulps plates, damp materials and slurries of solid particulate matter carried in suspension or containing a liquid medium.

In one form the invention resides in a pulp dewatering means comprising a fluid bed, said fluid bed comprising a delivery zone for receipt of said pulp from said hopper and a drying zone, said delivery zone being separated from the drying zone by a weir and having a porous floor and/or walk associated with a drain, said drying zone comprising a vibrating surface downwardly inclined from the said weir, the lower end of said drying zone depositing particulate material to a delivery outlet, said porous surface being associated with a plenum chamber below the porous surface which is connected to a source of hot gaseous fluid.

According to a preferred feature the delivery outlet is connected to a heat exchanger for further dewatering of said pulp.

According to a preferred feature of the previous feature the source of heat exhaust fluid comprises the exhaust of the heat exchanger.

According to a preferred feature the exhaust of the heat exchanger is associated with means for effecting forced airflow to said plenum chamber from the exhaust.

According to a further preferred feature of the invention said exhaust is associated with an inlet for cool air whereby said means for effecting said forced airflow draws both hot gases from the exhaust and cool air from the cool air inlet for discharge into said plenum chamber.

According to a preferred feature of the previous feature the inlet for cool air is located at the upper end of a stack extended upwardly from the exhaust.

Figure 1:
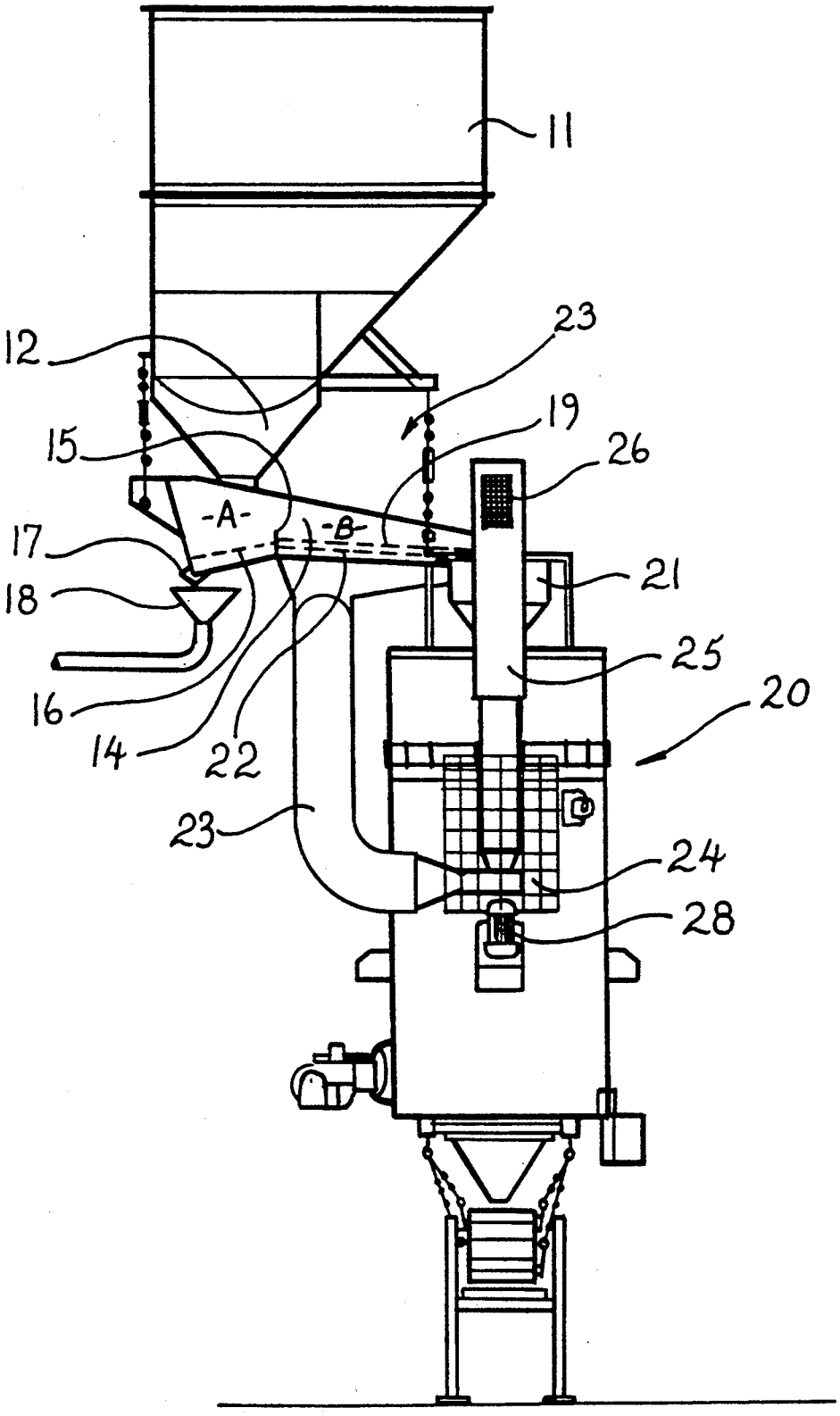
Figure 2:
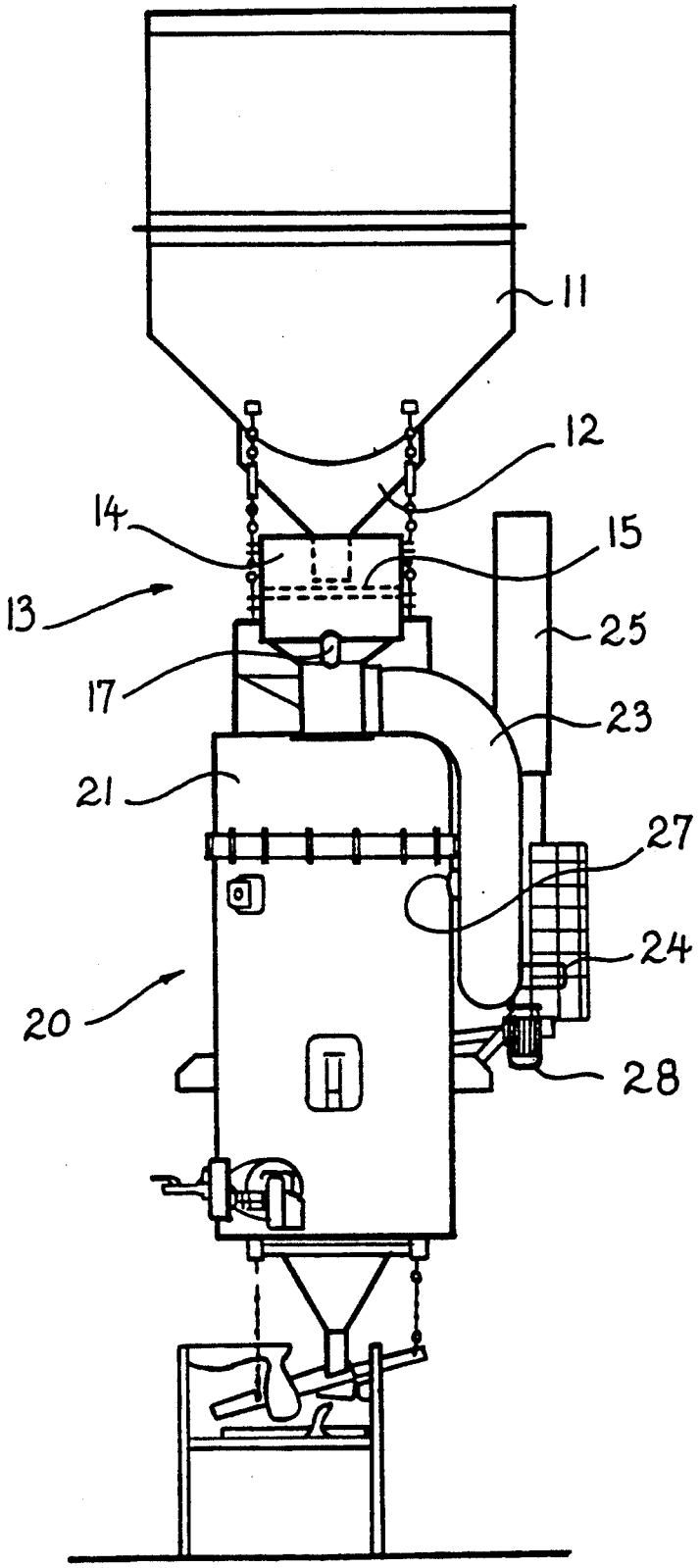

The invention will be more fully understood in the light of the following description of one specific embodiment. The description is made with reference to the accompanying drawings of which:

FIG. 1 is a side elevation of the embodiment for use in relation to a reactivation kiln; and FIG. 2 is a side elevation of the embodiment of FIG. 1.

The embodiment is directed to a means for dewatering carbon pulp prior to the introduction of the carbon pulp into a reactivation kiln of the form described in AU-B70646/87. The embodiment comprises a hopper 11 into which carbon pulp is deposited which has an outlet 12 for the delivery of the carbon pulp into the dewatering means 13. The dewatering means comprises a vibrating screen 14 which comprises a delivery zone A and a drying zone B separated by a weir 15. The delivery zone A has a porous floor 16 which is inclined downwardly away from the weir 15 and is associated with a plenum chamber below the porous floor which is provided with a drain 17 which delivers water drained therefrom into a drain outlet 18. The drying zone B also comprises a porous floor 19 which is inclined downwardly away from the weir 15 but with less inclination than the floor of the delivery zone whereby the lower end of the porous floor has a delivery outlet for the delivery of pulp into the inlet hopper of the reactivation kiln 20. The vibrating screen is caused to vibrate by suitable means to assist in the migration of the pulp material down the floor of the drying zone. The underneath the porous floor 19 of the drying zone A has a plenum chamber 22 into which hot exhaust gases from the reactivation kiln is delivered through a flue 23 into the plenum chamber and then into the pulp through the porous floor 19. The vibration of the vibrating screen and thus the porous floor 19 also causes the particles of the pulp to vibrate relative to each other and thus maximise the exposure of the particles to the hot exhaust air.

The flue is connected at its lower end to the outlet of a fan 24 which is located at the lower end of an upwardly extending air intake stack 25. A cool inlet 26 is provided at the upper end of the stack 25 and an inlet 27 for exhaust gases from the heat exchanger into the stack is provided in intermediate location therealong. A drive motor 28 for the fan 24 is supported at the lower end of the fan housing.

As indicated earlier the reactivation kiln shown in the drawings takes the form of the heat exchanger which is the subject of Australian patent application 70646/87.

In use wet carbon pulp is delivered into the hopper 11 and is allowed to flow into the dewatering means through the discharge outlet 12 of the hopper. Initially a quantity of carbon pulp gathers in the delivery zone A until it begins to overflow the weir 15 into the drying zone B. The carbon pulp which originally collects in the delivery zone A remains substantially static in the lower region thereof at least such that the further carbon pulp delivered into the delivery zone flows over that static portion. It seems that the presence of the static portion of the carbon pulp assists in drawing water from the further carbon pulp which flows over its surface such that a significant proportion of water is extracted from the carbon pulp before it overflows the weir 15 into the drying zone B. On migration of the carbon pulp into the drying zone B the vibration which is exerted on both the delivery zone A and a drying zone B causes relative vibration between the particles of the pulp and its migration over the porous floor 19. In addition the pulp is fluidization by the hot air which is injected into the plenum chamber 22 through the flue 23. Such fluidization is effected by air which is heated but which is significantly cooler than the temperature of the exhaust gases from the reactivation kiln by virtue of the presence of the cold air inlet 26 provided in the stack 25. By the time the carbon particles have reached the lower end of the drying zone B substantially most of the water has been driven from them such that on entry into the reactivation kiln they are substantially dry. As indicated in the specification of Australian patent application 70646/87 further draining of any residual water can be effected within the hopper of the reactivation kiln prior to the passage of the carbon particles through the heating chamber.

As indicated above the presence of the cool air inlet which allows the introduction of cold air into the hot exhaust gases from the reactivation kiln serves to control the temperature of the air being delivered to the drying zone A. In the event of the failure of the fan or the motor driving the fan the hot air exhaust will not be drawn into the flue 23 but rather will exhaust from the stack 25 and through the cold air inlet 26. Therefore the presence of the stack 25 and air inlet 26 serves in ensuring that the hot air and for drying the pulp on the vibrating bed is not overheated and caused to oxidise.

It should be appreciated that the scope of the present invention need not be limited to the particular scope of the embodiment described above.

The claims defining the invention are as follows:

1. A pulp dewatering means comprising a fluid bed, said fluid bed comprising a delivery zone for receipt of said pulp from a hopper and a drying zone, said delivery zone being separated from said drying zone by a weir and said delivery zone having a porous floor associated with a drain, said drying zone comprising a vibrating surface downwardly inclined from said weir, the lower end of said drying zone depositing particulate material at a delivery outlet, said porous surface being associated with a plenum chamber below said porous surface, said plenum chamber being connected to a source of hot gaseous fluid.

2. A pulp dewatering means as claimed at claim 1 wherein the delivery outlet is connected to a heat exchanger for further dewatering of said pulp.

3. A pulp dewatering means as claimed at claim 2 wherein the source of hot gaseous fluid comprises the exhaust of the heat exchanger.

4. A pulp dewatering means as claimed at claim 3 wherein said exhaust of said heat exchanger is associated with a means for effecting forced airflow to said plenum chamber from said exhaust.

5. A pulp dewatering means as claimed at claim 4 wherein said exhaust is associated with an inlet for cool air whereby said means for effecting said forced airflow draws both hot gases from the exhaust and cool air from the cool air inlet for discharge into said plenum chamber.

6. A pulp dewatering means as claimed at claim 5 wherein the inlet for cool air is located at the upper end of a stack extended upwardly from the exhaust.

7. A vibrating screen dewatering apparatus comprising:

a) a housing;
b) a porous surface in said housing;
c) a weir separating said porous surface into a delivery zone and a drying zone;
d) a delivery plenum under said delivery zone;
e) a drain associated with said delivery plenum;
f) a drying plenum under said drying zone;
g) a source of heated air associated with said drying plenum; and
h) a pulp outlet associated with said drying zone said pulp outlet positioned with respect to said drying zone opposite said weir.

8. A vibrating screen dewatering apparatus as claimed in claim 7 wherein said porous surface slopes down from said weir into both said delivery zone and said drying zone.

* * * * *